US012551763B2

(12) United States Patent
Matsunaga

(10) Patent No.: US 12,551,763 B2
(45) Date of Patent: Feb. 17, 2026

(54) IRON GOLF CLUB HEAD

(71) Applicant: Sumitomo Rubber Industries, Ltd., Hyogo (JP)

(72) Inventor: Kiyofumi Matsunaga, Kobe (JP)

(73) Assignee: Sumitomo Rubber Industries, Ltd., Hyogo (JP)

( * ) Notice: Subject to any disclaimer, the term of this patent is extended or adjusted under 35 U.S.C. 154(b) by 118 days.

(21) Appl. No.: 18/456,196

(22) Filed: Aug. 25, 2023

(65) Prior Publication Data

US 2024/0075353 A1 Mar. 7, 2024

(30) Foreign Application Priority Data

Sep. 1, 2022 (JP) ..... 2022-139424

(51) Int. Cl.
*A63B 53/04* (2015.01)
*A63B 60/52* (2015.01)

(52) U.S. Cl.
CPC ..... *A63B 53/0433* (2020.08); *A63B 53/0408* (2020.08); *A63B 53/047* (2013.01); *A63B 53/0475* (2013.01); *A63B 60/52* (2015.10); *A63B 2053/0491* (2013.01)

(58) Field of Classification Search
CPC ..... A63B 53/0433; A63B 53/0408; A63B 53/0475; A63B 53/047; A63B 60/52
USPC ..... 473/350
See application file for complete search history.

(56) References Cited

U.S. PATENT DOCUMENTS 2,332,342 A * 10/1943 Reach ..... A63B 53/047 473/248
5,386,996 A * 2/1995 Hiruta ..... A63B 60/00 473/346
5,472,203 A * 12/1995 Schmidt ..... A63B 53/04 473/350
5,776,010 A * 7/1998 Helmstetter ..... A63B 53/047 473/335
7,083,531 B2 * 8/2006 Aguinaldo ..... A63B 53/047 473/345
8,414,423 B2 * 4/2013 Hatton ..... A63B 53/06 473/335
8,777,774 B1 * 7/2014 Kim ..... A63B 60/02 473/335
8,870,675 B2 * 10/2014 Motokawa ..... A63B 53/047 473/328

(Continued)

FOREIGN PATENT DOCUMENTS

JP 2016-221181 A 12/2016

*Primary Examiner* — Sebastiano Passaniti
(74) *Attorney, Agent, or Firm* — Studebaker Brackett PLLC

(57) ABSTRACT

An iron golf club head includes a face portion having a striking face with a face center thereon, a virtual vertical plane passing through the face center and perpendicular to the striking face, and a sole portion extending backward from the face portion to form a bottom surface of the head. The sole portion includes a toe side slit extending forward from a sole rear edge on the toe side of the virtual vertical plane, a heel side slit extending forward from the sole rear edge on the heel side of the virtual vertical plane, a sole center portion demarcated between the toe side slit and the heel side slit, a sole toe portion detached from the sole center portion on the toe side by the toe side slit, and a sole heel portion detached from the sole center portion on the heel side by the heel side slit.

19 Claims, 8 Drawing Sheets

(56) References Cited

U.S. PATENT DOCUMENTS

| | | | | |
|---|---|---|---|---|
| 9,480,888 | B1 * | 11/2016 | Allen | A63B 60/54 |
| 9,586,105 | B1 * | 3/2017 | Westrum | A63B 60/42 |
| 11,033,788 | B1 * | 6/2021 | Hobbs | A63B 53/047 |
| 2002/0173375 | A1 * | 11/2002 | Asplund | A63B 53/047 473/328 |
| 2009/0186717 | A1 * | 7/2009 | Stites | A63B 53/047 473/335 |
| 2010/0130302 | A1 * | 5/2010 | Galloway | A63B 53/047 473/328 |
| 2012/0040772 | A1 * | 2/2012 | Potter | A63B 60/00 473/328 |
| 2014/0295993 | A1 * | 10/2014 | Tsurumaki | A63B 60/52 473/350 |
| 2016/0354650 | A1 | 12/2016 | Norimura | |
| 2019/0201762 | A1 * | 7/2019 | Hebreo | A63B 53/047 |

* cited by examiner

IRON GOLF CLUB HEAD

RELATED APPLICATIONS

This application claims the benefit of foreign priority to Japanese Patent Applications No. JP2022-139424, filed Sep. 1, 2022, which are incorporated by reference in its entirety.

FIELD OF THE INVENTION

The present disclosure relates to an iron golf club head.

BACKGROUND OF THE INVENTION

There is a demand for an iron golf club head capable of increasing a carry (flight distance) of a hit ball. In general, when the ball is hit at a sweet spot on a face portion, a large carry can be obtained. It should be noted that the sweet spot is a point at which a normal drawn from a center of gravity of the head down to a striking face of the face portion intersects the striking surface. See Japanese Unexamined Patent Application Publication No. 2016-221181, for example.

SUMMARY OF THE INVENTION

By the way, the iron golf club head is often used to hit a golf ball placed directly on the lawn, and therefore frequently hits the ball at a position about 15 mm above the lowest end of the striking face.

However, it is difficult for an iron golf club heads to have the sweet spot at such a low position as described above due to their structure.

The present disclosure was made in view of the above, and a primary object thereof is to provide an iron golf club head capable of increasing the carry of hit balls due to a novel structure thereof.

The present disclosure is an iron golf club head including:

when the head is in a reference state, a face portion having a striking face;

a face center on the striking face;

a virtual vertical plane passing through the face center and perpendicular to the striking face;

a toe;

a heel located opposite the toe; and a sole portion extending from the face portion to a rear of the head to form a bottom surface of the head, wherein the sole portion includes:

a toe side slit extending from a sole rear edge toward a front of the head on the toe side of the virtual vertical plane;

a heel side slit extending from the sole rear edge toward the front of the head on the heel side of the virtual vertical plane;

a sole center portion demarcated between the toe side slit and the heel side slit;

a sole toe portion detached from the sole center portion on the toe side by the toe side slit; and a sole heel portion detached from the sole center portion on the heel side by the heel side slit, and the front is the striking face side.

The iron golf club head of the present disclosure can increase the carry of a hit ball due to its novel structure.

DETAILED DESCRIPTION OF THE INVENTION

Embodiments of the present disclosure will now be described below in conjunction with accompanying drawings.

The embodiments herein are not intended to limit the present disclosure in any way. Further, various examples described in the embodiments may be implemented with one of other examples alone or with two or more of other examples in combination.

Embodiment 1

Figure 1:
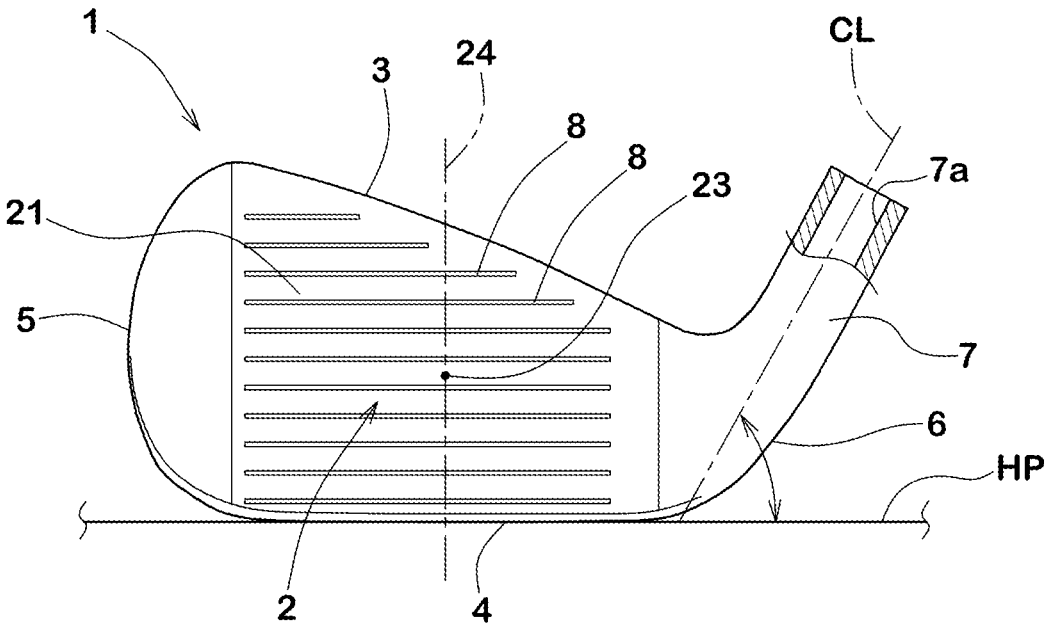
FIG. 1 is a front view of the iron golf club head of Embodiment 1.
Figure 2:
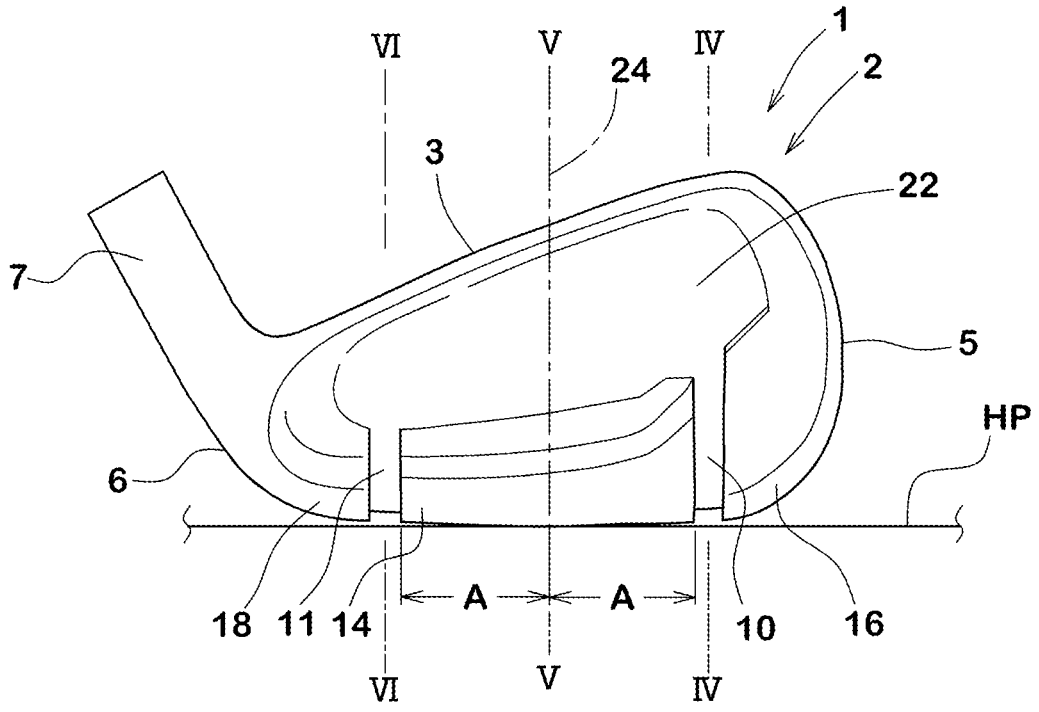
FIG. 2 is a rear view of the iron golf club head of Embodiment 1.
Figure 3:
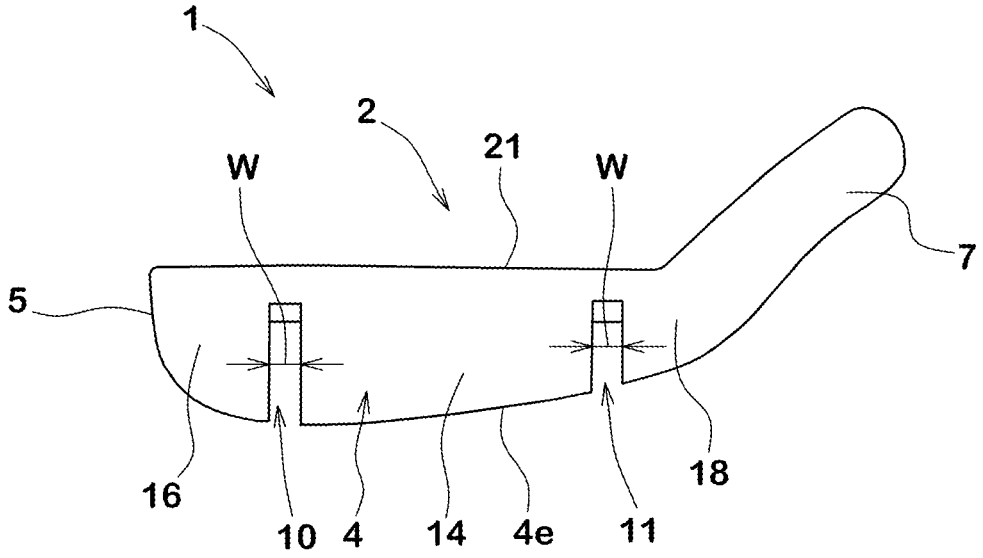
FIG. 3 is a bottom view of the iron golf club head of Embodiment 1.
Figure 4:
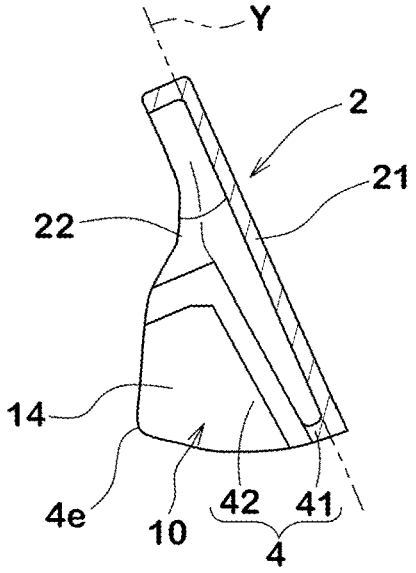
FIG. 4 is a cross-sectional view taken along IV-IV line of FIG. 2.
Figure 5:
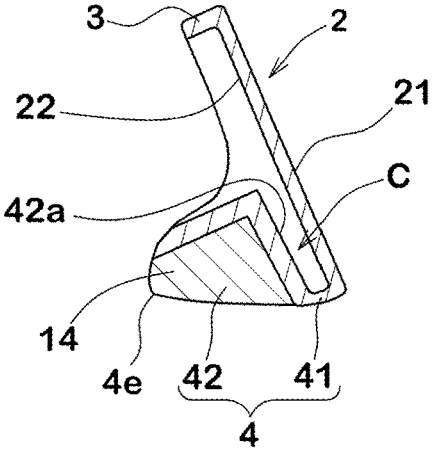
FIG. 5 is a cross-sectional view taken along V-V line of FIG. 2.
Figure 6:
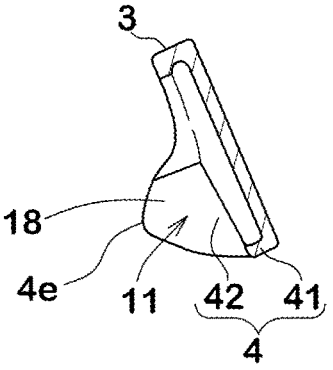
FIG. 6 is a cross-sectional view taken along VI-VI line of FIG. 2.

FIGS. 1 to 3 are a front view, a rear view, and a bottom view, respectively, of an iron golf club head (hereinafter may sometimes simply be referred to as "head") 1 of the present embodiment. Further, FIGS. 4 to 6 are cross-sectional views taken along lines IV-IV, V-V, and VI-VI in FIG. 2, respectively.

As shown in FIGS. 1 to 6, the head 1 includes a face portion 2, a top 3, a sole portion 4, a toe 5, a heel 6, and a hosel 7, for example. The head 1 of the present embodiment is entirely made of a metal material, for example. The head 1 may be partially made of non-metallic material such as fiber-reinforced plastic, for example.

The face portion 2 includes a striking face 21, which is the surface for striking the ball. The striking face 21 is the intended primary striking area for the head 1. As shown in FIG. 1, a plurality of face lines 8 are formed on the striking face 21. The face lines 8 are thin grooves extending linearly in the toe-heel direction. Face lines 8 help increase friction with the ball. It should be noted that the face lines 8 are omitted except in FIG. 1.

[Reference State]

In FIGS. 1 and 2, the head 1 is in a reference state. As conceptually shown in FIG. 7, the "reference state" of the head 1 in the present specification is a state in which the head 1 is placed on a horizontal plane (HP) so that the face lines 8 formed on the striking face 21 are parallel to the horizontal plane (HP). In the reference state, a central axis (CL) of the hosel 7 of the head 1 (which corresponds to the axis of the golf club shaft) is placed within a reference vertical plane (VP). The reference vertical plane (VP) is a plane perpendicular to the horizontal plane (HP). In the reference state, the face lines 8 are parallel to both the horizontal plane (HP) and the reference vertical plane (VP). In the present specification and claims, unless otherwise specified, the configurations of various parts are described assuming that the head 1 is placed in the reference state.

Figure 7:
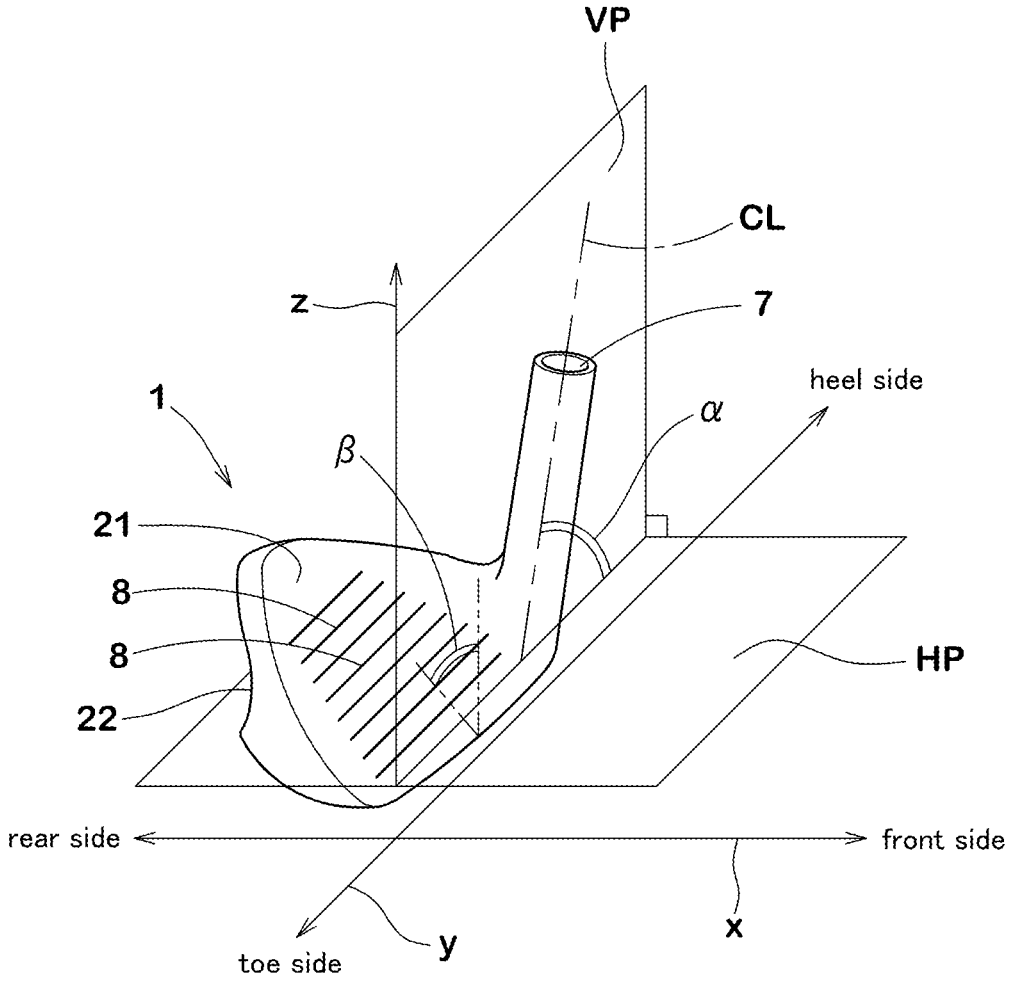
FIG. 7 is a perspective view illustrating the reference state of the iron golf club head.

In FIG. 7, the sign α indicates a lie angle, and the sign β indicates a loft angle. The lie angle α is the angle between the horizontal plane (HP) and the central axis (CL) of the hosel 7. The loft angle β is the angle between the reference vertical plane (VP) and the striking face 21. These lie angle α and the loft angle β are predetermined for the head 1 and are usually listed in product catalogs.

[Directions of Head]

In the head 1, front, front side, and forward means the side of the striking face 21. Rear, rear side, back, back side, or backward of the head 1 means the side opposite to the front and the front side (the side of a back face 22). Further, a head front-back direction is a direction of the x-axis orthogonal to the reference vertical plane (VP) in FIG. 7. Furthermore, the toe-heel direction of the head 1 is the horizontal y-axis direction perpendicular to the head front-back direction. The vertical direction of the head 1 is the direction of the z-axis, which is orthogonal to both the x-axis and the y-axis. "Upper side" (top) and "lower side" (bottom) of the head 1 mean "upper side" (top) and "lower side" (bottom) in the reference state, respectively.

[Structure of various parts of Head]

Referring to FIGS. 1 to 2, the face portion 2 has the striking face 21 and the back face 22 on its opposite side. In the present embodiment, the striking face 21 is formed by a single plane, except for the face lines 8.

The face portion 2 further includes a face center 23 and a virtual vertical plane 24.

The face center 23 is a point on the striking face 21 and is an intermediate position in the toe-heel direction between ends of the face lines 8 closest to the toe 5 and ends of the face lines 8 closest to the heel 6. The face center 23 is also an intermediate position in the direction along the striking face 21 between a top 3 side end and a sole portion 4 side end of the striking face 21 at the intermediate position. The face center 23 is one of the ideal hitting positions for many golfers.

A virtual vertical plane 24 is a virtual vertical plane passing through the face center 23 and perpendicular to the striking face 21.

As shown in FIG. 5, the top 3 extends from an upper edge of the striking face 21 to the rear of the head 1 and constitutes the upper surface portion of the head 1, for example.

As shown in FIGS. 1 and 2, the toe 5 is the end portion of the head 1 farthest from the hosel 7 in the toe-heel direction and smoothly connects the top 3 and the sole portion 4.

The heel 6 is the end portion located opposite the toe 5 in the toe-heel direction of the head 1. The hosel 7 extends upward from the heel 6.

As shown in FIG. 1, the hosel 7 has a shaft insertion hole (7*a*) for receiving a golf club shaft (not shown). The central axis (CL) of the hosel 7 is defined by the central axis of the shaft insertion hole (7*a*).

FIG. 3 is a bottom view of the head 1 viewed from the direction along the striking face 21. As shown in FIGS. 3 and 4, the sole portion 4 extends from the face portion 2 to the rear of the head to form a lower surface of the head, for example. The sole portion 4 extends to a sole rear edge (4*e*) which is the most rear-side edge of the head. The sole rear edge (4*e*) extends in the toe-heel direction at the most rear-side position in the bottom view of FIG. 3.

As shown in FIG. 5, the sole portion 4 of the present embodiment includes a first portion 41 located on the face portion side, and a second portion 42 located behind the first portion 41 and rising upward more than the first portion 41. The second portion 42 has a front surface (42*a*) spaced apart from the back face 22 of the face portion 2. The front surface (42*a*) faces the back face 22 of the face portion 2. The head 1 is provided with a cavity (C) formed between the front surface (42*a*) and the back face 22 of the face portion 2 to extend toward the bottom surface of the head. The cavity (C) of the present embodiment is a so-called undercut cavity.

Figure 8:
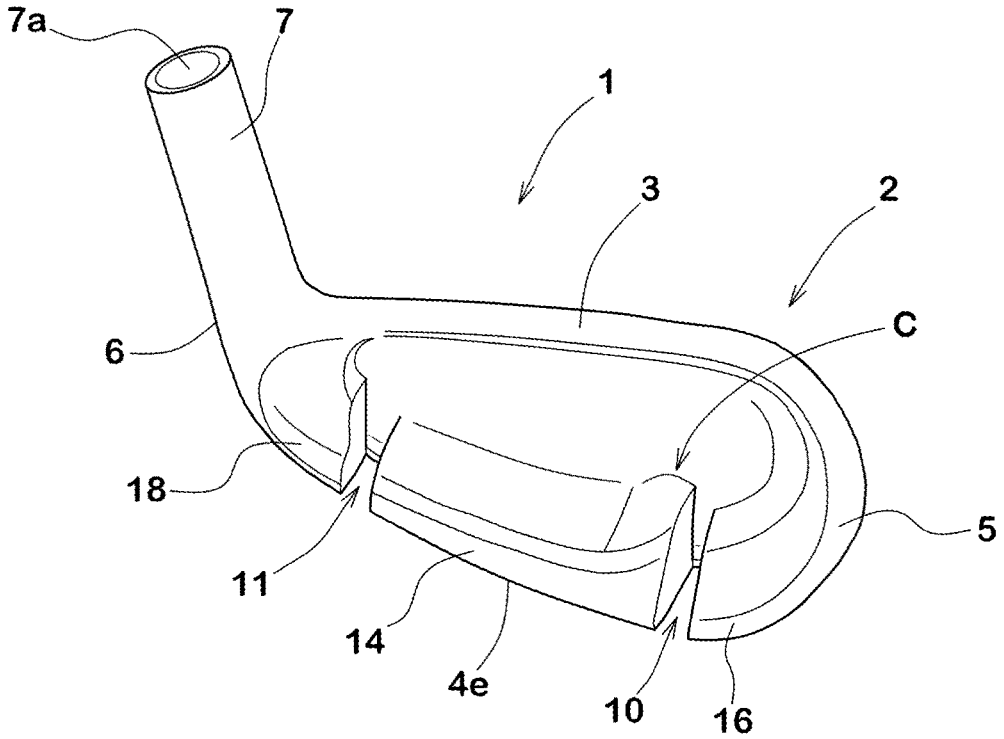
FIG. 8 is a perspective view of the iron golf club head of Embodiment 1 as seen from the upper rear.
Figure 9:
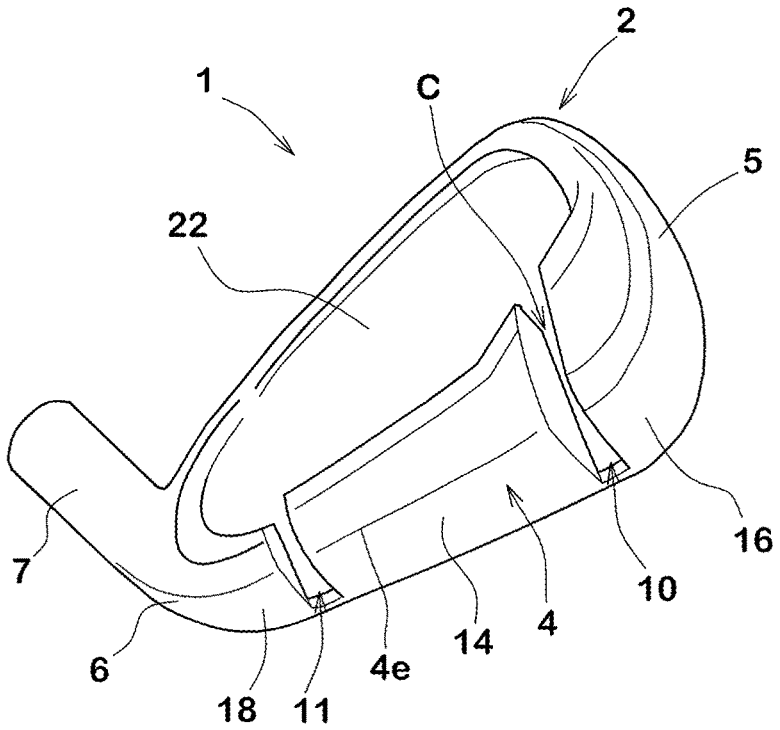
FIG. 9 is a perspective view of the iron golf club head of Embodiment 1 as seen from the lower rear.

FIG. 8 is a perspective views of the head 1 as seen from the upper rear and FIG. 9 is a perspective view of the head 1 as seen from the lower rear. As shown in FIGS. 8 and 9, the sole portion 4 has a toe side slit 10 and a heel side slit 11.

The toe side slit 10 in the present embodiment is arranged at a position closer to the toe 5 than the virtual vertical plane 24 is. Further, the toe side slit 10 extends forward from the sole rear edge (4*e*) toward the front of the head 1, for example. Furthermore, the toe side slit 10 penetrates the sole portion 4 in the vertical direction of the head 1.

The heel side slit 11 of the present embodiment is provided at a position closer to the heel 6 than the virtual vertical plane 24 is. Further, the heel side slit 11 extends from the sole rear edge (4*e*) to the front of the head 1, for example. Furthermore, the heel side slit 11 penetrates the sole portion 4 in the vertical direction of the head 1.

In addition, the sole portion 4 has a sole center portion 14, a sole toe portion 16, and a sole heel portion 18.

The sole center portion 14 is demarcated between the toe side slit 10 and the heel side slit 11 in the sole portion 4. The sole toe portion 16 is the portion of the sole portion 4 on the toe 5 side of the toe side slit 10. The sole heel portion 18 is the portion of the sole portion 4 on the heel 6 side of the heel side slit 11. Thus, the sole toe portion 16 is separated (detached) from the sole center portion 14 by the toe side slit 10. Similarly, the sole heel portion 18 is separated from the sole center portion 14 by the heel side slit 11.

[Action of the Present Embodiment]

As shown in FIGS. 8 and 9, the head 1 in the present embodiment has the sole center portion 14 detached from the sole toe portion 16 and the sole heel portion 18. Therefore, the sole center portion 14 is prone to bend in the head front-back direction by itself. Focusing on such characteristics, the head 1 in the present embodiment enhances a resilience performance of the head 1 by generating deflection between the face portion 2 and the sole center portion 14 when the ball is hit, and by applying the restoring force of the deflection to the face portion 2. This action is described in more detail below.

Figure 10:
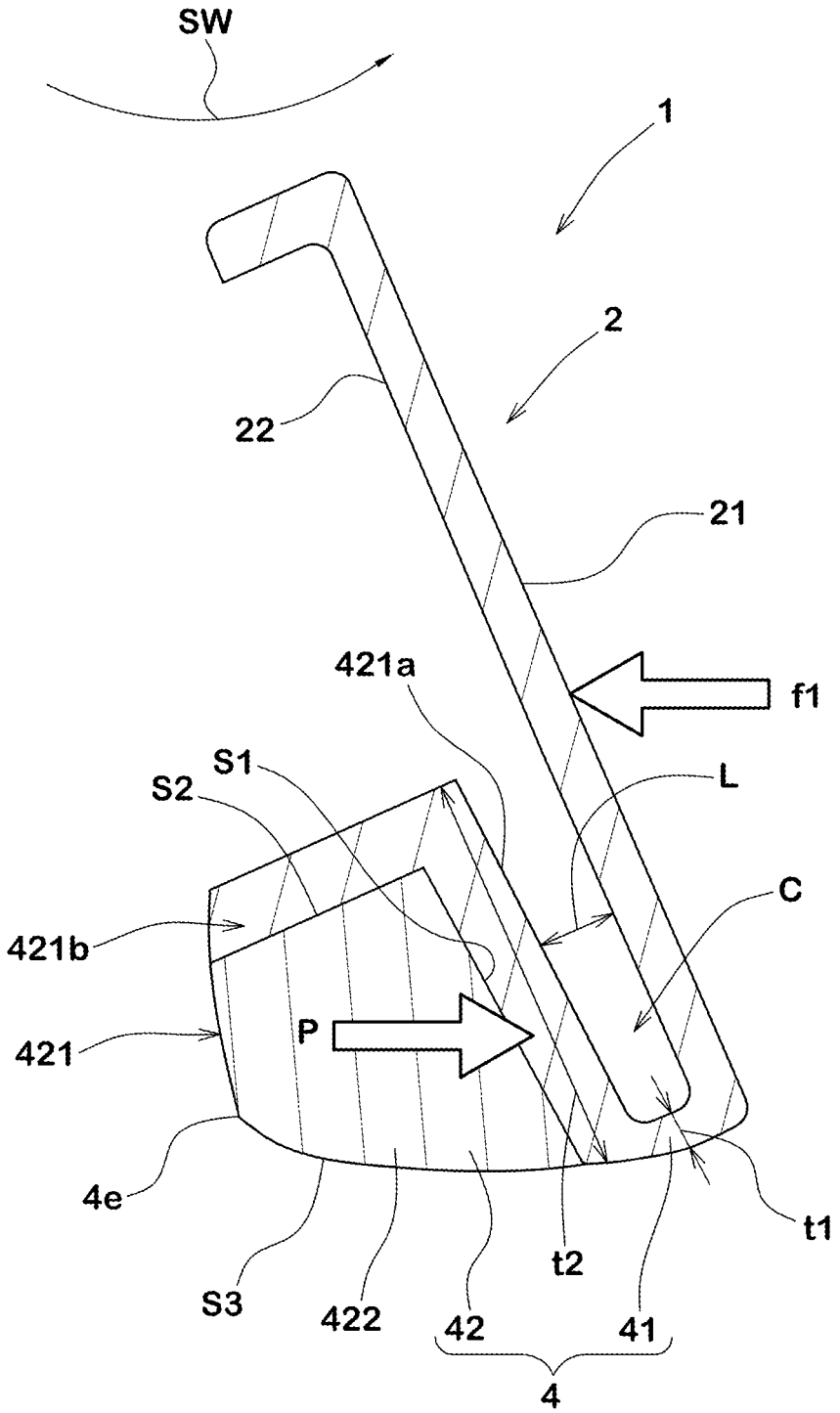
FIG. 10 is an enlarged cross-sectional view of the iron golf club head of Embodiment 1.

FIG. 10 is an enlarged cross-sectional view of the head 1 taken at the position of the virtual vertical plane 24. In FIG. 10, an arrow SW indicates the swing direction of the head 1. When the ball strikes the striking face 21 of the head 1 during the swing process, the face portion 2 receives a force (f1) and bends backward of the head. At this time, since the sole center portion 14 is configured to move relatively easily, a large elastic deflection (bending) occurs in the vicinity of the connection between the face portion 2 and the sole center portion 14, where elastic energy is stored. Next, the deflection between the face portion 2 and the sole center portion 14 is gradually restored after a short time has passed from the moment of impact. At this time, since the sole center portion 14 has a momentum (P) in a swing direction (SW), much of the restoring force acts as a resilience force pushing back the face portion 2 forward. The head 1 of the present embodiment improves the resilience performance of the face portion 2 and increases the carry of a hit ball by such action.

As described above, the head 1 in the present embodiment can increase the carry of hit balls through a novel structure different from the low center-of-gravity design of the head that has been used in iron golf club heads. However, it goes without saying that the present disclosure may be implemented in combination with conventional techniques for lowering the center-of-gravity of the head in order to further increase the carry. More preferred embodiments of the disclosure are described below.

[Thickness of First Portion]

As shown in FIG. 10, the first portion 41 may be configured to have a thickness (t1) smaller than a thickness (t2) of the second portion 42. In this case, at the moment the ball is hit, the sole center portion 14 (the second portion 42) can easily bend more toward the face portion 2 with the first portion 41 being the starting point, i.e., the face portion 2 can easily bend more toward the sole center portion 14 (the second portion 42). As the deflection amount of the sole center portion 14 increases, the restoring force (resilience force) acting on the face portion 2 also increases proportionally. Therefore, in this example, further improvement in the resilience performance of the face portion 2 can be expected. In particular, if the thickness (t1) of the first portion 41 is reduced, sufficient improvement in the resilience performance can be expected even when the ball is struck at a lower position on the striking face 21.

The thickness (t1) of the first portion 41 is not particularly limited, but may be 3.0 mm or less, preferably 2.5 mm or less, more preferably 2.0 mm or less, for example, from the point of view of promoting the bending of the sole center portion 14. On the other hand, from the viewpoint of durability of the head 1, the thickness (t1) of the first portion 41 may be 1.0 mm or more, preferably 1.5 mm or more, for example. In the present specification, the thickness (t1) of the first portion 41 is defined as the thickness measured parallel to the striking face 21 of the face portion 2.

[Thickness (t2) of Second Portion]

The thickness (t2) of the second portion 42 is not particularly limited, but is preferably greater than the thickness (t1) of the first portion 41. This increases the weight of the second portion 42, which in turn increases the kinetic energy of the second portion 42 during the swing. Therefore, in this example, the restoring force (the resilience force) acting on the face portion 2 is increased, and a further improvement in the resilience performance of the head 1 can be expected.

The thickness (t2) of the second portion 42 is not particularly limited, but may be, for example, 3.0 mm or more, more preferably 4.0 mm or more, and even more preferably 5.0 mm or more, in terms of promoting the bending of the sole center portion 14. On the other hand, from the viewpoint of the practical upper limit weight of the head 1, the thickness (t2) of the second portion 42 may be 20 mm or less, preferably 15 mm or less, more preferably 10 mm or less, for example. In the present specification, the thickness (t2) of the second portion 42 is defined as the thickness measured parallel to the striking face 21 of the face portion 2.

[Shape of Cavity]

It is preferred that a length (L) of the cavity (C) in the direction perpendicular to the striking face 21 increases continuously toward the top of the head. With the cavity (C) having such a shape, the second portion 42 can be bent more toward the face portion 2 with the first portion 41 being the starting point at the moment the ball is hit. Therefore, in this example, an effect of further improving the resilience performance of the head 1 can be expected. Although the length (L) of the cavity (C) is not particularly limited, it may be appropriately determined so that the bent second portion 42 does not come into contact with the back face 22 of the face portion 2 when the ball is struck.

[Preferred Examples of Toe Side Slit and Heel Side Slit]

As shown in FIGS. 4 and 6, if the sole portion 4 has the second portion 42, it is preferred that the toe side slit 10 and the heel side slit 11 extend through the second portion 42. The second portion 42 has a relatively large thickness. By providing the toe side slit 10 and the heel side slit 11 in the second portion 42, the sole center portion 14 can be more easily bent when the ball is struck. In this regard, it is even more preferred for the toe side slit 10 and the heel side slit 11 to extend over the entire length in the head front-back direction of the second portion 42, as shown in FIGS. 4 and 6.

If the sole portion 4 has the first portion 41, the toe side slit 10 and the heel side slit 11 may extend up to the first portion 41. In such an example, the sole center portion 14 is more likely to flex (bend) when the ball is struck. On the other hand, in order to avoid impairing the durability of the face portion 2, it is preferred that the toe side slit 10 and the heel side slit 11 terminate so as not to reach the face portion 2. More specifically, as shown in FIG. 4, when a virtual face thinnest line (Y) is defined that passes through the point of the minimum thickness of the face portion 2 and is parallel to the striking face 21, it is preferred that the toe side slit 10 and the heel side slit 11 terminate without reaching the face thinnest line (Y).

The positions of the toe side slit 10 and the heel side slit 11 in the toe-heel direction are not particularly limited. Considering the distribution of hitting positions of various golfers, it is preferred that the toe side slit 10 and the heel side slit 11 are each arranged outside the distribution range. This allows the sole center portion 14 to be configured to be more flexible when the ball is struck. From this point of view, it is preferred that the toe side slit 10 and the heel side slit 11 are each arranged spaced apart from the virtual vertical plane 24 by a distance (A) of 15 to 35 mm in the toe-heel direction, as shown in FIG. 2.

As shown in FIG. 3, a width (W) of each of the toe side slit 10 and the heel side slit 11 is not particularly limited. In a preferred example, the width (W) of the toe side slit 10 and heel side slit 11 is determined such that the deflection of the sole center portion 14 is not hindered by contact with the sole toe portion 16 and sole heel portion 18 during typical ball striking. As an example, the width (W) of each of the toe side slit 10 and heel side slit 11 is 1 mm or more, more preferably 2 mm or more, for example. Further, the width (W) of each of the toe side slit 10 and the heel side slit 11 is 5 mm or less, preferably 4 mm or less, more preferably 3 mm or less, for example. Furthermore, the length in the head front-back direction of each of the toe side slit 10 and the heel side slit 11 measured in the bottom view of FIG. 3 may be 5 mm or more, preferably 10 mm or more, for example.

[Weight Member]

As shown in FIG. 10, the sole portion 4 can include a main body 421 having a first specific gravity and a weight member 422 having a second specific gravity greater than the first specific gravity. Such a configuration may be applied together with the preferred examples described so far, or applied alone and independently of them.

The weight member 422 of the present embodiment is arranged on the back side and at a low position in the sole center portion 14 of the sole portion 4, for example. This allows more weight to be distributed on the sole rear edge (4*e*) side and makes it easier for the sole portion 4 to bend more toward the face portion 2 with the connection to the face portion 2 being the starting point. Further, the weight member 422 can also lower the center of gravity of the head 1.

When the sole center portion 14 is configured to include the first portion 41 and the second portion 42, it is preferred that the weight member 422 is arranged in the second portion 42. In a particularly preferred embodiment, the second portion 42 consists of the main body 421 and the weight member 422.

The main body 421 includes a front wall portion (421*a*) forming a front surface of the second portion 42, and an upper wall portion (421*b*) extending backward from the front wall portion (421*a*) to form an upper surface of the second portion 42. In this example, the main body 421 is integrally formed with the face portion 2 of the head 1 and the hosel 7 by the metal forming them. Metal materials for the main body 421 include carbon steel, stainless steel, maraging steel, titanium, titanium alloys, and the like, for example.

The weight member 422 is arranged in a lower space surrounded by the front wall portion (421*a*) and the upper wall portion (421*b*). In a preferred example, the weight member 422 has, for example, a solid structure having a first surface (S1) contacting the front wall portion (421*a*), a second surface (S2) contacting the upper wall portion (421*b*), and a third surface (S3) forming the outer surface of the sole portion 4. It is preferred that a contact length between the front wall portion (421*a*) and the first surface (S1) is, for example, 5 mm or more in order to for the second portion 42 to bend more when hitting the ball. Similarly, it is preferred that a contact length between the upper wall portion (421*b*) and the second surface (S2) is 5 mm or more, for example.

The second specific gravity of the weight member 422 is not particularly limited as long as it is greater than the first specific gravity of the main body 421, but it may be 10.0 or more, preferably 12.0 or more, for example. Alloys containing tungsten are suitable for the weight member 422.

The toe side slit 10 and the heel side slit 11 may be left as voids. Alternatively, the toe side slit 10 and the heel side slit 11 may be provided with covers or inserts (not shown) made of rubber, resin, elastomer, and the like, which are soft enough not to impede the deformation of the sole center portion 14 when hitting a ball. These covers or inserts can prevent the toe side slit 10 and the heel side slit 11 from being jammed with foreign objects and the like.

Embodiment 2

Figure 11:
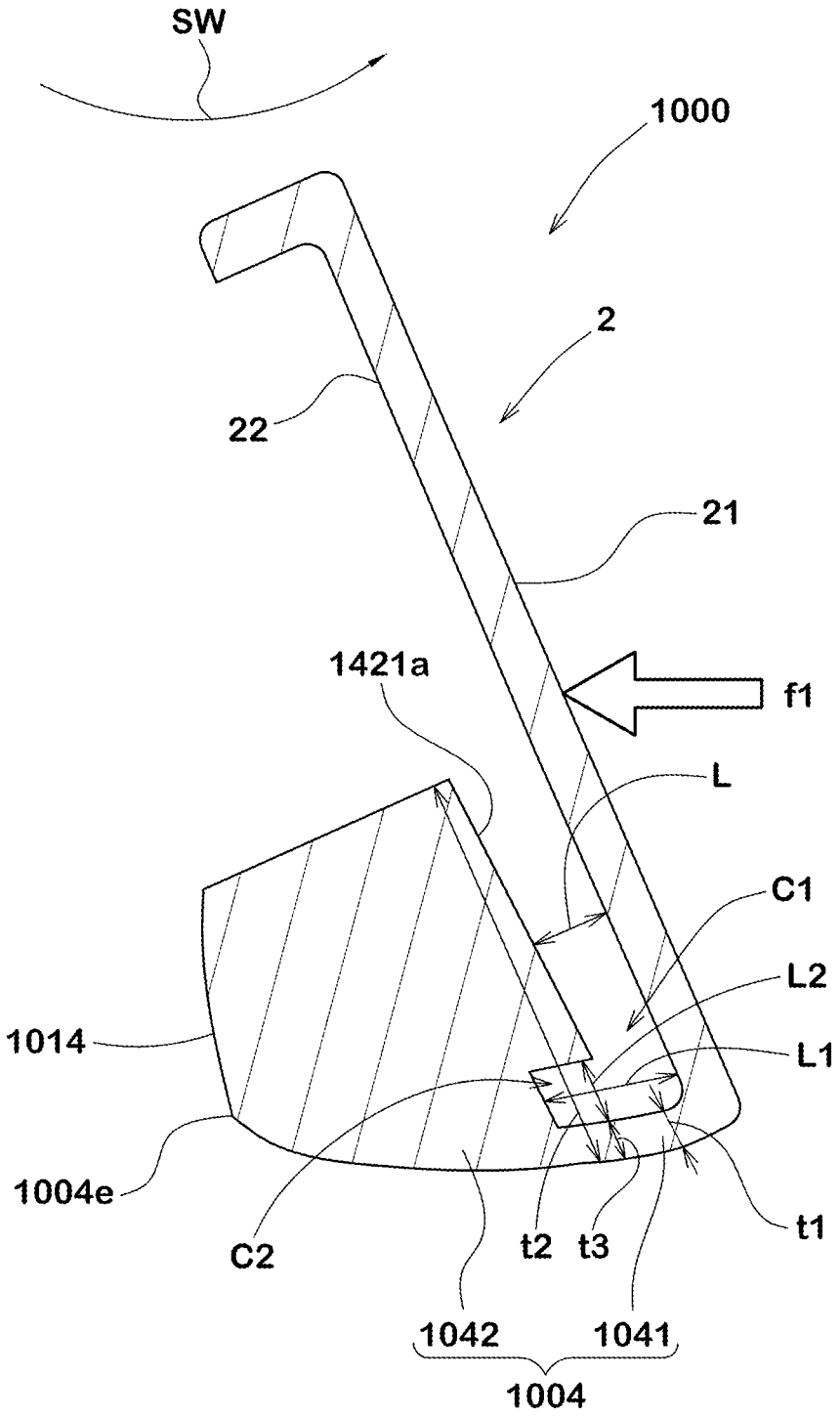
FIG. 11 is an enlarged cross-sectional view of an iron golf club head of Embodiment 2.
Figure 12:
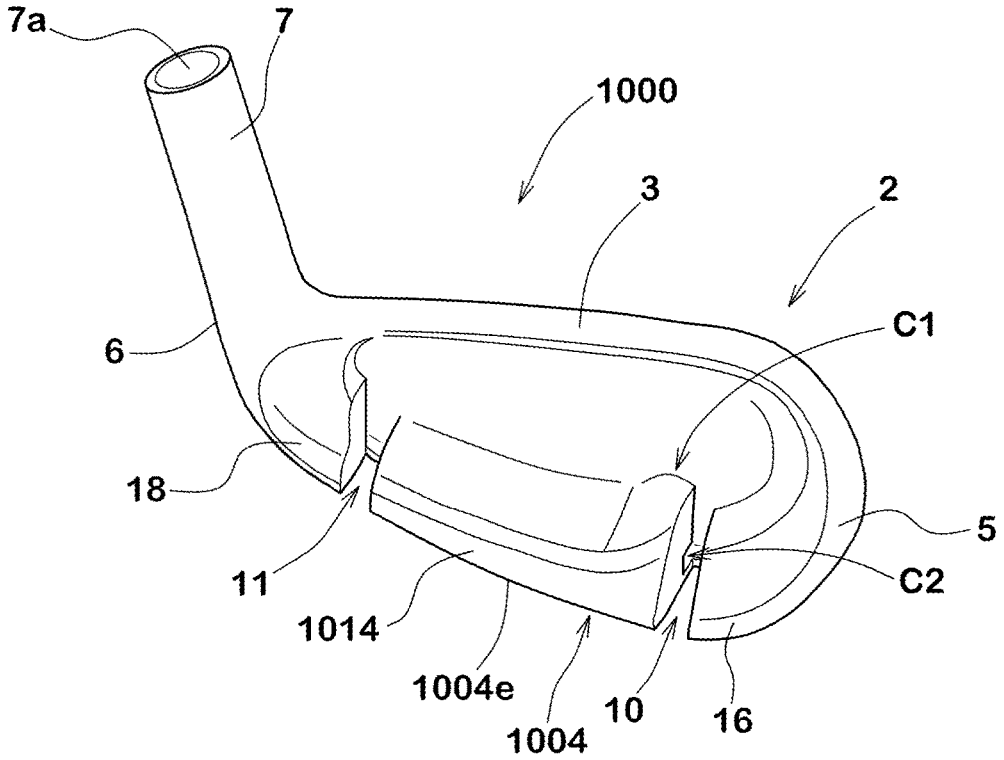
FIG. 12 is a perspective view of the iron golf club head of Embodiment 2 as seen from the upper rear.
Figure 13:
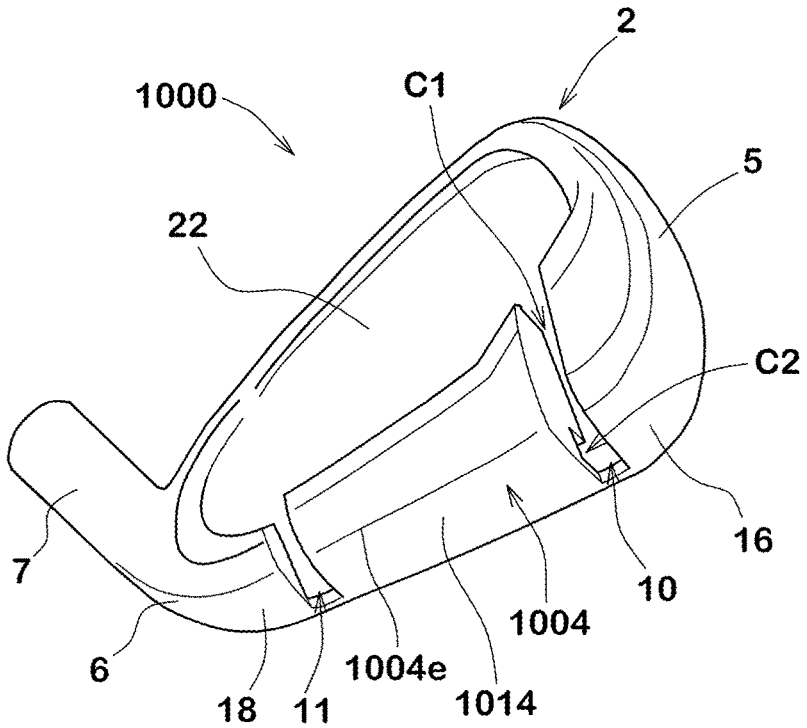
FIG. 13 is a perspective view of the iron golf club head of Embodiment 2 as seen from the lower rear.

FIG. 11 is an enlarged cross-sectional view of an iron golf club head 1000 (hereinafter, may simply be referred to as "head 1000") according to another embodiment (Embodiment 2) of the present disclosure taken at the position of the virtual vertical plane 24. FIG. 12 is a perspective view of the head 1000 as seen from the upper rear and FIG. 13 is a perspective view of the head 1000 as seen from the lower rear. For elements, components, and configurations common with the iron golf club head 1 of Embodiment 1, the same reference signs are assigned and descriptions thereof are omitted.

The head 1000 includes the face portion 2, the top 3, a sole portion 1004, the toe 5, the heel 6, and the hosel 7, for example. The head 1000 of the present embodiment is entirely made of a metal material, for example. The head 1000 may be partially made of non-metallic material such as fiber-reinforced plastic, for example. It should be noted that the reference state, the horizontal plane (HP), the central axis (CL), and the reference vertical plane (VP) of the head 1000 are the same as those of the head 1.

The definitions of "front", "rear (back)", "upper side (top)", and "lower side (bottom)" are the same for the head 1000 as the head 1. The sole portion 1004 extends to a sole rear edge (1004*e*) which is the most rear-side edge of the head.

As shown in FIG. 11, the face portion 2 and the sole portion 1004 are integrally formed of the same material in the head 1000. Therefore, a first portion 1041 and a second portion 1042 of the sole portion 1004 are also formed of the same material. The face portion 2 and the sole portion 1004 are made of a metal material or metal materials, for example. The metal material(s) forming the main body 421 in Embodiment 1 can be used for the face portion 2 and the sole portion 1004. It should be noted that the sole portion 1004 of the head 1000 of the present embodiment may be configured to include a main body having a first specific gravity and a weight member having a second specific gravity greater than the first specific gravity similar to the head 1 of Embodiment 1.

Similar to the sole portion 4 of the head 1, the sole portion 1004 has the toe side slit 10 and the heel side slit 11, thereby, the sole portion 1004 is divided into a sole center portion 1014, the sole toe portion 16, and a sole heel portion 18.

The sole portion 1004 has a first portion 1041 corresponding to the first portion 41 and a second portion 1042 corresponding to the second portion 42. The head 1000 has a first cavity (C1) surrounded by the face portion 2, the first portion 1041, and the second portion 1042. The first cavity (C1) corresponds to the cavity (C) of the head 1. The second portion 1042 of the sole center portion 1014 has a second cavity (C2) formed at a lower part thereof. The second cavity (C2) is a space (cavity) recessed backward from a front wall portion (1421*a*) of the second portion 1042 and communicates with the cavity (C). Since the sole portion 1004 is provided with the second cavity (C2), the second portion 1042 can bend more easily with the first portion 1041 being the starting point. Therefore, the face portion 2 and the second portion 1042 can get closer to each other when the ball is struck, thereby, greater restoring force (resilience force) can act on the face portion 2. The second cavity (C2) of the present embodiment is smoothly connected with the first cavity (C1) without having a step between a bottom surface of the cavity (C2) and a bottom surface of the first cavity (C1) (a top surface of the first portion 1041), but it is not particularly limited to this, and they may have a step between them.

The second cavity (C2) has a depth (L1) and a height (L2). The depth (L1) is not particularly limited, but may be 3.0 mm or more, preferably 4.0 mm or more, more preferably 5.0 mm or more, for example, from the point of view of promoting the bending of the sole center portion 1014. Further, the depth (L1) may be 20.0 mm or less, preferably 15.0 mm or less, more preferably 12.0 mm or less, for example, from the point of view of ensuring adequate weight of the second portion 1042. Furthermore, it is preferred that the depth (L1) increases continuously toward the top of the head. It should be noted that the depth (L1) is a length in a direction parallel to the length (L) of the first cavity (C1) and perpendicular to the striking face 21.

The height (L2) is not particularly limited, but may be 0.5 mm or more, preferably 1.0 mm or more, more preferably 1.5 mm or more, for example, from the point of view of promoting the bending of the sole center portion 1014. Further, the height (L2) may be 5.0 mm or less, preferably 4.0 mm or less, more preferably 3.0 mm or less, for example, from the point of view of ensuring adequate weight of the second portion 1042. It should be noted that the height (L2) is a length in a direction parallel to the striking face 21.

It should be noted that a thickness (t3) of a portion of the second portion 1042 below the second cavity (C2) is not particularly limited, but may be, for example, the same as the thickness (t1) of the first portion 1041 of the head 1000. The thickness (t1) of the first portion 1041 can be the same as the thickness (t1) of the first portion 41 of the head 1 in Embodiment 1.

In order to sufficiently exert the above effects, it is preferred that the second cavity (C2) is provided over the entire width in the toe-heel direction of the sole center portion 1014 of the sole portion 1004. It should be noted that the second cavity (C2) may be provided only in a part of the sole center portion 1014. Even in this case, the above-described effects can be obtained to some extent. Further, the depth (L1) and the height (L2) may be appropriately adjusted depending on the range in which the second cavity (C2) is formed (e.g., whether the entire width or a part thereof in the toe-heel direction of the sole center portion 1014 is formed with the second cavity (C2) or depending on the width in the toe-heel direction of the second cavity (C2) if it's partially formed).

Although the second cavity (C2) is provided only in the sole center portion 1014 in the present embodiment, it is not particularly limited to this. The second cavity (C2) may also be provided in the sole toe portion and the sole heel portion (not shown).

While the embodiments of the present disclosure have been described above, the present disclosure can be embodied in various forms without being limited to the illustrated embodiments. Further, this disclosure includes equivalents.

The present disclosure includes the following aspects.

[Present Disclosure 1]

An iron golf club head including:

when the head is in a reference state, a face portion having a striking face;

a face center on the striking face;

a virtual vertical plane passing through the face center and perpendicular to the striking face;

a toe;

a heel located opposite the toe; and a sole portion extending from the face portion to a rear of the head to form a bottom surface of the head, wherein the sole portion includes:

a toe side slit extending from a sole rear edge toward a front of the head on the toe side of the virtual vertical plane;

a heel side slit extending from the sole rear edge toward the front of the head on the heel side of the virtual vertical plane;

a sole center portion demarcated between the toe side slit and the heel side slit;

a sole toe portion detached from the sole center portion on the toe side by the toe side slit; and a sole heel portion detached from the sole center portion on the heel side by the heel side slit, and the front is the striking face side.

[Present Disclosure 2]

The head according to Present Disclosure 1, wherein the sole portion includes a first portion located on the face portion side, and a second portion located behind the first portion 41 and rising upward, the first portion has a thickness smaller than a thickness of the second portion, and the toe side slit and the heel side slit extend through the second portion.

[Present Disclosure 3]

The head according to Present Disclosure 2, wherein the toe side slit and the heel side slit extend over the entire length of the second portion in a front-back direction.

[Present Disclosure 4]

The head according to Present Disclosure 2, wherein the toe side slit and the heel side slit extend to the first portion.

[Present Disclosure 5]

The head according to any one of Present Disclosures 2 to 4, wherein the thickness of the first portion is from 1.0 to 3.0 mm

[Present Disclosure 6]

The head according to any one of Present Disclosures 2 to 4, wherein the thickness of the second portion is 3.0 mm or more.

[Present Disclosure 7]

The head according to any one of Present Disclosures 2 to 4, wherein the face portion has a back face opposite to the striking face, the second portion has a front surface forming a cavity between the back face, and a length of the cavity orthogonal to the striking face increases upward.

[Present Disclosure 8]

The head according to Present Disclosure 1 or 2, wherein the sole center portion includes a main body having a first specific gravity and a weight member having a second specific gravity larger than the first specific gravity.

[Present Disclosure 9]

The head according to Present Disclosure 1 or 2, wherein the toe side slit and the heel side slit are each arranged on a respective side of and spaced apart from the virtual vertical plane by a distance of 15 mm or more and 35 mm or less in a toe-heel direction.

[Present Disclosure 10]

The head according to Present Disclosure 1 or 2, wherein each of the toe side slit and the heel side slit has a width of 2 mm or more.

[Present Disclosure 11]

An iron golf club head including:

when the head is in a reference state, a face portion having a striking face and a back face opposite to the striking face;

a face center on the striking face;

a virtual vertical plane passing through the face center and perpendicular to the striking face;

a toe;

a heel located opposite the toe; and a sole portion extending from the face portion to a rear of the head to form a lower surface of the head, wherein, the sole portion includes:

a toe side slit extending from a sole rear edge toward a front of the head on the toe side of the virtual vertical plane;

a heel side slit extending from the sole rear edge toward the front of the head on the heel side of the virtual vertical plane;

a sole center portion demarcated between the toe side slit and the heel side slit;

a sole toe portion detached from the sole center portion on the toe side by the toe side slit; and a sole heel portion detached from the sole center portion on the heel side by the heel side slit, wherein, the sole portion consists of a first portion and a second portion, the first portion is located on the face portion side and a lower side, the second portion is located behind the first portion and rises upward more than the first portion to form a first cavity between the back face of the face portion, the first portion connects a lower end portion of the face portion and a lower end portion of the second portion, the second portion has a front wall portion facing the back face with the first cavity therebetween and a second cavity recessed backward from the front wall portion at least in the sole center portion, the second cavity is arranged at a lower part of the second portion and communicates with a lower end of the first cavity, and the front is the striking face side.

DESCRIPTION OF REFERENCE SIGNS

1 head
2 face portion
4 sole portion
4*e* sole rear edge
5 toe
6 heel
10 toe side slit
11 heel side slit
14 sole center portion
16 sole toe portion
18 sole heel portion
21 striking face
22 back face
23 face center
24 virtual vertical plane
41 first portion
42 second portion
42*a* front surface
421 main body
422 weight member
C cavity
C1 first cavity
C2 second cavity

The invention claimed is:

1. An iron golf club head comprising:

when the head is in a reference state, a face portion having a striking face;

a face center on the striking face;

a virtual vertical plane passing through the face center and perpendicular to the striking face;

a toe;

a heel located opposite the toe;

a sole portion extending from the face portion to a rear of the head to form a bottom surface of the head; and a top located opposite the sole portion with the face portion therebetween, wherein the sole portion includes:

a toe side slit extending from a sole rear edge toward a front of the head on the toe side of the virtual vertical plane;

a heel side slit extending from the sole rear edge toward the front of the head on the heel side of the virtual vertical plane;

a sole center portion demarcated between the toe side slit and the heel side slit;

a sole toe portion detached from the sole center portion on the toe side by the toe side slit; and a sole heel portion detached from the sole center portion on the heel side by the heel side slit, the front of the head is the striking face, the top is positioned on an upper side and the sole portion is located on a lower side, and the toe side slit and the heel side slit are parallel to each other and each extend an entire length in a top-bottom direction of the sole portion, wherein the sole portion includes a first portion located rearward of the face in a front-back direction of the head, and a second portion located behind the first portion in the front-back direction, the first portion and the second portion include a bottom surface of the sole portion, the second portion rises upward from the bottom surface of the sole portion toward the top of the head, the first portion has a thickness in the top-bottom direction smaller than a thickness of the second portion in the top-bottom direction, and the toe side slit and the heel side slit extend through the second portion.

2. The head according to claim 1, wherein the toe side slit and the heel side slit extend over an entire length of the second portion in the front-back direction.

3. The head according to claim 1, wherein the toe side slit and the heel side slit extend to the first portion.

4. The head according to claim 1, wherein the thickness of the first portion is from 1.0 to 3.0 mm.

5. The head according to claim 1, wherein the thickness of the second portion is 3.0 mm or more and 20 mm or less.

6. The head according to claim 1, wherein the face portion has a back face opposite to the striking face, the second portion has a front surface spaced apart from the back face, and a cavity is formed between the front surface and the back face, and a length of the cavity orthogonal to the striking face increases upward in the top-bottom direction.

7. The head according to claim 1, wherein the sole center portion includes a main body having a first specific gravity and a weight member having a second specific gravity larger than the first specific gravity.

8. The head according to claim 1, wherein the toe side slit and the heel side slit are each arranged on a respective side of and spaced apart from the virtual vertical plane by a distance of 15 mm or more and 35 mm or less in a toe-heel direction.

9. The head according to claim 1, wherein each of the toe side slit and the heel side slit has a width of 2 mm or more and 5 mm or less.

10. An iron golf club head comprising:

when the head is in a reference state, a face portion having a striking face and a back face opposite to the striking face;

a face center on the striking face;

a virtual vertical plane passing through the face center and perpendicular to the striking face;

a toe;

a heel located opposite the toe;

a sole portion extending from the face portion to a rear of the head to form a bottom surface of the head; and a top located opposite the sole portion with the face portion therebetween, wherein, the sole portion includes:

a toe side slit extending from a sole rear edge toward a front of the head on the toe side of the virtual vertical plane;

a heel side slit extending from the sole rear edge toward the front of the head on the heel side of the virtual vertical plane;

a sole center portion demarcated between the toe side slit and the heel side slit;

a sole toe portion detached from the sole center portion on the toe side by the toe side slit; and a sole heel portion detached from the sole center portion on the heel side by the heel side slit, wherein, the sole portion consists of a first portion and a second portion, the first portion is located on a rear surface of the face portion side, the second portion is located behind the first portion and rises upward in a top-bottom direction more than the first portion to form a first cavity between a front surface of the second portion and the back face, the first portion connects a lower end portion of the face portion and a lower end portion of the second portion, the second portion has a front wall portion facing the back face with the first cavity therebetween and a second cavity recessed backward from the front wall portion at least in the sole center portion, the second cavity is arranged at a lower part of the second portion and communicates with a lower end of the first cavity, the front of the head is the striking face, the top is positioned on an upper side and the sole portion is located on a lower side, and the toe side slit and the heel side slit are parallel to each other and each extend an entire vertical length of the sole portion.

11. The head according to claim 10, wherein the first portion has a thickness in the top-bottom direction smaller than a thickness of the second portion in the top-bottom direction, and the toe side slit and the heel side slit extend through the second portion.

12. The head according to claim 11, wherein the toe side slit and the heel side slit extend over an entire length of the second portion in a front-back direction.

13. The head according to claim 11, wherein the toe side slit and the heel side slit extend to the first portion.

14. The head according to claim 11, wherein the thickness of the first portion is from 1.0 to 3.0 mm.

15. The head according to claim 11, wherein the thickness of the second portion is 3.0 mm or more and 20 mm or less.

16. The head according to claim 11, wherein a length of the cavity orthogonal to the striking face increases upward in the top-bottom direction.

17. The head according to claim 10, wherein the second cavity is provided over an entire width of the sole center portion in a toe-heel direction.

18. The head according to claim 10, wherein the toe side slit and the heel side slit are each arranged on a respective side of and spaced apart from the virtual vertical plane by a distance of 15 mm or more and 35 mm or less in a toe-heel direction.

19. The head according to claim 10, wherein each of the toe side slit and the heel side slit has a width of 2 mm or more and 5 mm or less.

* * * * *